US010344435B2

(12) United States Patent
Berning et al.

(10) Patent No.: US 10,344,435 B2
(45) Date of Patent: Jul. 9, 2019

(54) MARKING UNDERGROUND OBSTACLES

(71) Applicant: Wirtgen GmbH, Windhagen (DE)

(72) Inventors: Christian Berning, Zülpich (DE); Martin Lenz, Grossmaischeid (DE); Cyrus Barimani, Königswinter (DE)

(73) Assignee: Wirtgen GmbH (DE)

( * ) Notice: Subject to any disclaimer, the term of this patent is extended or adjusted under 35 U.S.C. 154(b) by 264 days.

(21) Appl. No.: 15/412,376

(22) Filed: Jan. 23, 2017

(65) Prior Publication Data

US 2018/0209105 A1 Jul. 26, 2018

(51) Int. Cl.
*E01C 23/01* (2006.01)
*E01C 23/12* (2006.01)
(Continued)

(52) U.S. Cl.
CPC ..... *E01C 23/01* (2013.01); *B05B 15/60* (2018.02); *B05C 11/1021* (2013.01); *B05D 1/02* (2013.01);
(Continued)

(58) Field of Classification Search
CPC ..... E01C 23/01; E01C 23/088; E01C 23/127; B05C 5/00; B05C 11/1021
(Continued)

(56) References Cited

U.S. PATENT DOCUMENTS 5,025,150 A * 6/1991 Oldham ..... G01V 5/02 250/253
5,607,205 A 3/1997 Burdick et al.
(Continued)

FOREIGN PATENT DOCUMENTS

DE 29911821 U1 * 4/2000 ..... F26B 21/001
DE 102005005736 A1 9/2006
(Continued)

OTHER PUBLICATIONS

English language abstract for HTK-Heiztechnik Heizanlagen, German Patent Publication No. DE29911821U1, published May 25, 2000 (2 pages) (Year: 2000).*
(Continued)

*Primary Examiner* — David J Bagnell
*Assistant Examiner* — Michael A Goodwin
(74) *Attorney, Agent, or Firm* — Lucian Wayne Beavers; Patterson Intellectual Property Law, PC

(57) ABSTRACT

A method is provided for preparing an area of the ground surface to be milled by a milling machine. Prior to performing any milling operation on the area of the ground surface, a survey vehicle separate from the milling machine is used to traverse the area. The survey vehicle detects the presence of buried obstacles with a sensor and generates a sensor output signal indicative of the presence of the buried obstacle. The sensor output signal is received in a controller which generates a sprayer actuation signal and responds to the sensor output signal. A marking sprayer is actuated in response to the sprayer actuation signal and sprays the ground surface above the obstacle with a visible marking emitted from the sprayer. Subsequently, a milling machine separate from the survey vehicle may be utilized to mill the ground surface and by observation of the visible markings the operator may avoid impacting the milling drum with the buried obstacles.

34 Claims, 12 Drawing Sheets

(51) Int. Cl.

| | |
|---|---|
| ***E01C 23/088*** | (2006.01) |
| ***B05C 11/10*** | (2006.01) |
| ***E01F 9/518*** | (2016.01) |
| ***B05B 15/60*** | (2018.01) |
| ***B05D 1/02*** | (2006.01) |

(52) U.S. Cl.
CPC ..... *E01C 23/088* (2013.01); *E01C 23/127* (2013.01); *E01F 9/518* (2016.02)

(58) Field of Classification Search
USPC ..... 324/345, 329, 207.13, 207.15, 207.16, 324/239, 66, 67, 326, 244; 118/668, 712
See application file for complete search history.

(56) References Cited

U.S. PATENT DOCUMENTS

| | | | | |
|---|---|---|---|---|
| 6,119,376 | A | 9/2000 | Stump | |
| 7,077,601 | B2 | 7/2006 | Lloyd | |
| 7,372,247 | B1 | 5/2008 | Giusti et al. | |
| 7,451,721 | B1 * | 11/2008 | Garza | F16L 1/11 116/209 |
| 7,489,130 | B2 | 2/2009 | Behnke et al. | |
| 7,717,521 | B2 | 5/2010 | Hall et al. | |
| 7,887,142 | B2 | 2/2011 | Hall et al. | |
| 8,314,608 | B2 | 11/2012 | Hall et al. | |
| 9,096,977 | B2 | 8/2015 | Fritz et al. | |
| 2007/0044329 | A1 * | 3/2007 | Mitchell | F16L 1/11 33/1 E |
| 2008/0216021 | A1 * | 9/2008 | Berning | E01C 19/00 715/846 |
| 2009/0016818 | A1 | 1/2009 | Hall et al. | |
| 2010/0063691 | A1 * | 3/2010 | Hall | B28D 1/18 701/50 |
| 2012/0001638 | A1 | 1/2012 | Hall et al. | |
| 2014/0048624 | A1 * | 2/2014 | Olsson | B65D 83/203 239/375 |
| 2014/0348584 | A1 * | 11/2014 | Fritz | G05D 1/0214 404/72 |
| 2015/0035693 | A1 | 2/2015 | Hall et al. | |
| 2016/0060826 | A1 | 3/2016 | Berning et al. | |
| 2017/0307670 | A1 * | 10/2017 | Olsson | G01R 29/085 |

FOREIGN PATENT DOCUMENTS

| | | | |
|---|---|---|---|
| JP | 2533955 | B2 | 9/1996 |
| JP | 0959918 | A | 3/1997 |
| JP | 2857781 | B2 | 2/1999 |
| JP | 2004239763 | A | 8/2004 |
| WO | 2008010772 | A1 | 1/2008 |

OTHER PUBLICATIONS

EPO Search Report on corresponding European Application No. EP 18 15 2709, dated May 16, 2018, 8 pages (not prior art).

* cited by examiner

MARKING UNDERGROUND OBSTACLES

BACKGROUND OF THE INVENTION

1. Field of the Invention

Methods and apparatus are disclosed for locating and marking the surface above buried obstacles prior to a ground milling operation.

2. Description of the Prior Art

During the process of milling a ground surface it is desirable to avoid contact of the milling drum with buried obstacles such as pipelines or other objects. This is to avoid both damage to the buried object and/or damage to the milling drum itself.

This is particularly important when using milling drums carrying diamond tip bits due to the cost of the diamond tip bits.

One system which has been proposed for identifying the presence of buried obstacles is shown in Hall et al. U.S. Pat. No. 7,887,142. The Hall system incorporates a sensor and marking system on the road milling machine, which has many disadvantages.

Accordingly, there is a continuing need for improved methods of detecting and avoiding such buried obstacles during ground milling operations.

SUMMARY OF THE INVENTION

In one aspect of the invention a method is provided for preparing an area of a ground surface to be milled by a milling machine. The method may include steps of:

(a) prior to performing any milling operation on the area of the ground surface, traversing the area with a survey vehicle separate from the milling machine, the survey vehicle including a sensor, a marking sprayer and a controller;

(b) detecting the presence of buried obstacles with the sensor and generating a sensor output signal indicative of the presence of the obstacle;

(c) receiving the sensor output signal in the controller and generating a sprayer actuation signal in response to the sensor output signal; and (d) actuating the marking sprayer in response to the sprayer actuation signal and spraying the ground surface above the obstacle with a visible marking emitted from the sprayer.

In one embodiment the survey vehicle may be a non-self-propelled vehicle towed by a self-propelled towing vehicle. With such an arrangement the method may be performed at a towing speed of at least 10 km/hr.

Alternatively, a smaller survey vehicle may be utilized which is manually propelled.

Alternatively, the survey vehicle may be self-propelled.

Upon detection of the presence of a buried obstacle, the method may further include a step of following a path of the obstacle with the survey vehicle and marking the entirety of the continuous buried obstacle within the area of the ground surface.

The visible marking may include a visible indication of the depth of the obstacle under the ground surface. The visible indication of depth may include a variable color, a variable intensity, or a variation in sprayed indicia as the visible indication of depth. These methods may be combined.

Additionally, the visible indication of depth may include a visible indication of a maximum permissible milling depth that will avoid the buried obstacle.

The sprayer may include an array of spray nozzles distributed across a width of a path traverse by the survey vehicle, and one or more selected spray nozzles may be actuated to spray the ground surface.

The sensor may include an array of sensor elements distributed across the width of the path traverse by the survey vehicle, and each sensor element may be associated with at least one of the spray nozzles.

Alternatively, the sprayer may include a spray nozzle moveable across a width of a path traverse by the spray vehicle, and the spray nozzle may be moved to a selected location and then actuated to spray the ground surface.

Optionally, the method may include a step of drying the ground surface prior to the marking of the ground surface.

The marking may be performed with a waterproof paint.

The method may include traversing the area of the ground surface in a pattern so that substantially the entire area is surveyed and marked prior to performing the milling operation. Additional markings may show where the survey has already taken place and where not, so that the pattern can be chosen with minimal overlap on the one hand and without missing a part of the entire area on the other hand.

The visible marking preferably covers a contour of the buried obstacle.

After the surveying and marking operation, the ground surface may be milled with at least one milling machine separate from the survey vehicle. During the milling operation the presence of the visible markings on the ground surface is observed, and the milling machine is controlled in response to those markings so as to avoid impacting the underground obstacles with a milling drum of the milling machine.

The observation may be performed by a human operator of the milling machine directly observing the ground surface.

Optionally, the observation may be performed by the human operator observing images of the ground surface on a display.

Optionally, the observation may be performed automatically by a visual sensor located on the machine and the controlling of the milling machine may be performed automatically in response to signals from the visual sensor.

The controlling of the milling machine may include adjusting a milling depth of the milling drum of the milling machine.

The milling drum may be raised entirely out of engagement with the ground, or the milling drum may be raised to a depth sufficiently high to avoid the buried obstacle.

Optionally, the controlling of the milling machine may include steering the milling machine around the buried obstacle. The milling operation may be performed with one milling machine or with a plurality of milling machines operating simultaneously or sequentially.

A survey vehicle apparatus is disclosed for surveying an area of a ground surface and marking the ground surface to indicate the presence of buried obstacles.

The apparatus includes a vehicle frame and a plurality of ground engaging units supporting the vehicle frame from the ground surface. All of the ground engaging units may be non-powered so that the survey vehicle is non-self-propelled. A sensor may be carried by the vehicle frame and configured to detect the presence of the buried obstacles and to generate sensor output signals indicative of the presence of the buried obstacles. A marking emitter carried by the vehicle frame is configured to emit visible markings on to the ground surface above the buried obstacles. A controller is configured to receive the sensor output signals and to generate actuation signals to actuate the marking emitter.

The sensor output signals may include an indication of the depth of the buried obstacles, and the visible markings may include visible indications of the depth of the buried obstacles.

As with the method described above, the visible indications may include variable color, variable intensity, variation in sprayed indicia, and the visible indication may include a visible indication of a maximum permissible milling depth.

The marking emitter may include an array of spray nozzles distributed across a width of the path traversed by the survey vehicle.

The sensor may include an array of sensor elements distributed across the width of the path traversed by the survey vehicle, with each sensor element being associated with at least one of the spray nozzles.

Optionally, the marking emitter may include a spray nozzle movable across a width of the path traversed by the survey vehicle.

The system of the present invention provides many advantages, especially as compared to an obstacle detection and marking system carried on the milling machine itself, such as shown in Hall et al. U.S. Pat. No. 7,887,142. One such advantage is that a survey vehicle towed by a tow vehicle allows the surveying operation to be performed at a much higher speed that could be done with a system mounted on a milling machine.

Another advantage of the present invention is that one survey vehicle can serve many milling machines, whereas the use of an obstacle detection and marking system carried on the milling machine requires each milling machine to have its own expensive survey unit.

Another advantage is that a survey vehicle separate from the milling machine is much more maneuverable than is the milling machine itself.

Yet another advantage is that a separate survey vehicle allows the marked ground surface to be readily visible to the operator of the separate milling machine when approaching the marked area, whereas the use of an obstacle detection and marking system carried on the milling machine gives the operator very little time to react to the presence of an obstacle.

And another advantage of the present invention is that the operator of the milling machine can observe the ground surface to be milled and plan the passes to be made to mill the entire area with a minimum of missed areas due to the presence of obstacles.

Various other objects, features and advantages of the present invention will be readily apparent to those skilled in the art upon reading of the following disclosure when taken in conjunction with the accompanying drawings.

DETAILED DESCRIPTION

Figure 1A:
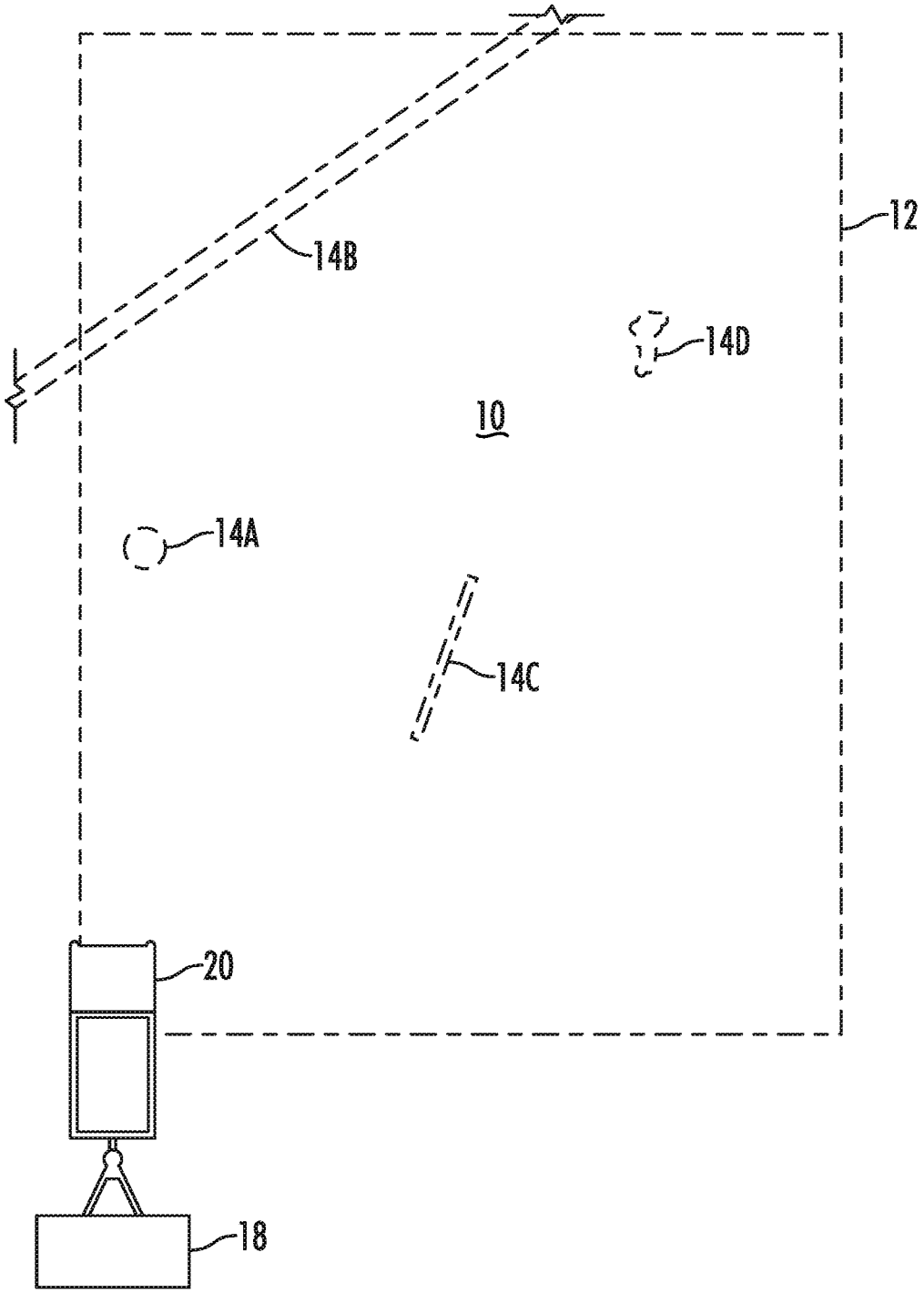
FIG. 1*a* is a schematic plan view of an area of a ground surface which is to be later milled by a milling machine. A tow vehicle towing a non-self-propelled survey vehicle is shown approaching the lower left corner of the area. Various buried obstacles within the area of the ground surface are indicated in dash lines.

In FIG. 1A, a ground surface 10 is shown which is to be milled by a milling machine. The phantom line rectangle 12 denotes an area 12 of the ground surface 10 which is intended to be milled by the milling machine.

Several buried obstacles 14A, 14B, 14C, 14D are schematically illustrated.

Figure 10:
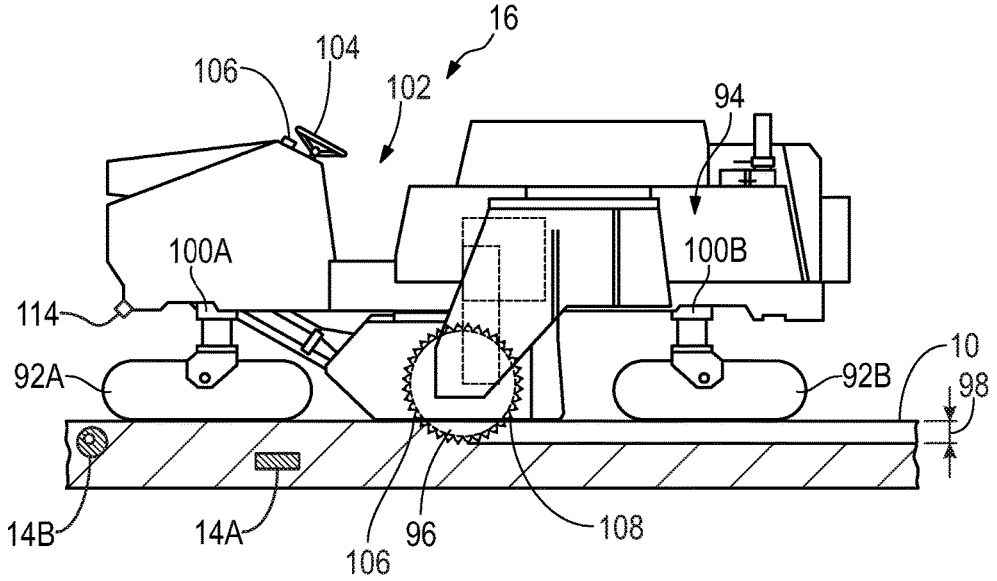
FIG. 10 is a schematic side elevation view of a milling machine milling the ground surface.

The area 12 is to be later milled by a milling machine 16 such as shown in FIG. 10, which is further described below.

Prior to performing any milling operation on the area 12 of ground surface 10 it is desired to locate and identify the location of each of the buried obstacles 14A-14D by painting or otherwise marking the ground surface above the obstacles. This is performed with a survey vehicle 18. The particular survey vehicle 18 schematically illustrated in FIG. 1A is designed to be towed by a powered vehicle 20 such as a pickup truck.

Figure 4:
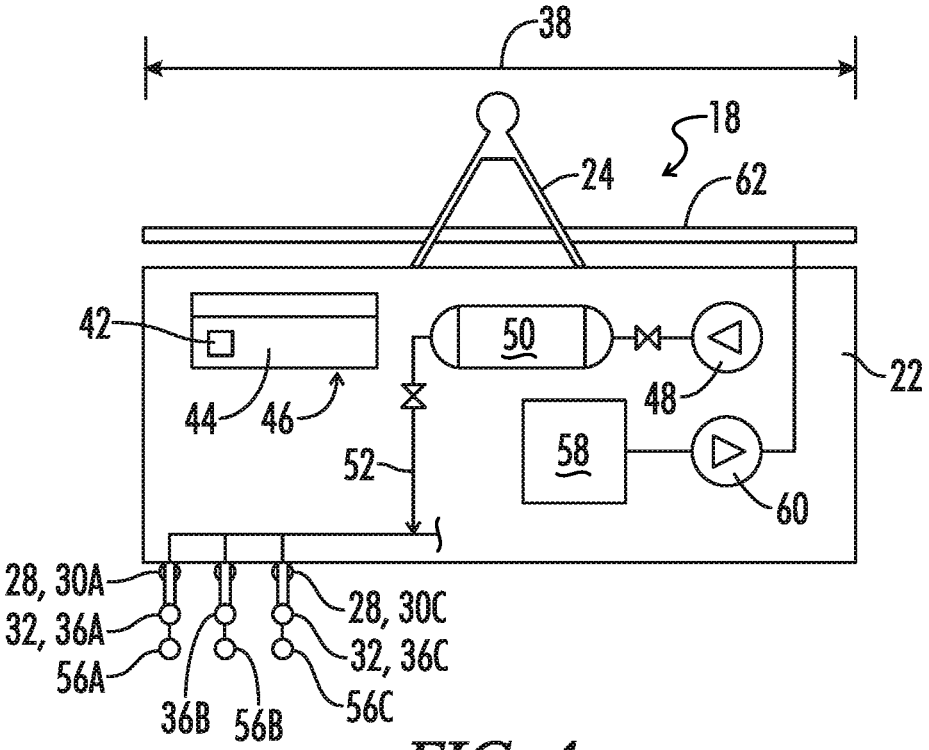
FIG. 4 is a schematic plan view of a survey vehicle designed to be towed behind a towing vehicle.
Figure 5:
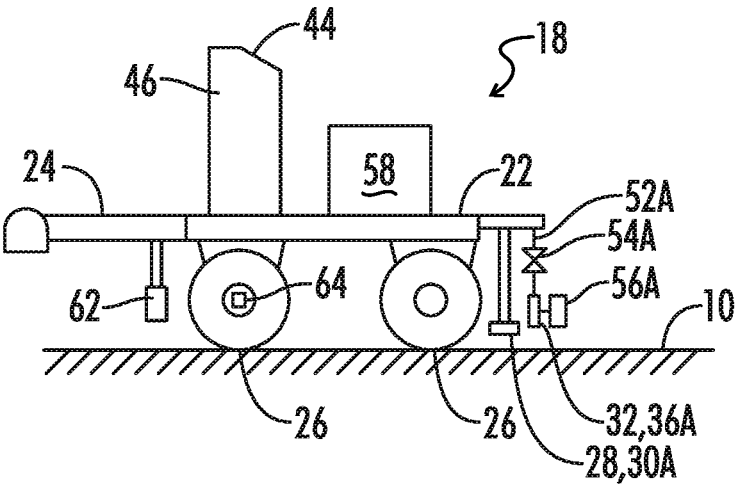
FIG. 5 is a schematic left side elevation view of the survey vehicle of FIG. 4.

The Survey Vehicle of FIGS. 4 and 5

The details of construction of the survey vehicle 18 are best shown in FIGS. 4 and 5.

In one embodiment the survey vehicle 18 includes a vehicle frame 22 having a tow bar 24 attached to the front thereof for connection of the survey vehicle 18 to the towing vehicle 20. A plurality of ground engaging units 26, which as illustrated in FIG. 5 may be wheels 26, support the vehicle frame 22 from the ground surface 10. In the illustrated embodiment all of the ground engaging units 26 are non-powered so that the survey vehicle 18 is non-self-propelled. Alternatively, the survey vehicle could be constructed to be self-propelled such as by providing a drive motor to one or more of the ground engaging units 26. The drive motor could be hydraulic or electric, or of any other suitable form. Alternatively, the survey vehicle could be attached to the front of a self-propelled vehicle.

A sensor 28 which may include a number of separate sensor elements 30A-30C, etc., is carried by the vehicle frame 22 and configured to the detect the presence of the buried obstacles 14A-14D and to generate sensor output signals indicative of the presence of the buried obstacles.

A marking emitter 32 is carried by the vehicle frame 22 and is configured to emit visible markings 34A, 34B, 34C and 34D on the ground surface 10 above the buried obstacles 14A-4D, respectably.

The marking emitter 32 may include an array of spray nozzles 36A, 36B, 36C, etc. distributed across a width 38 of a path 40 traversed by the survey vehicle 18. A controller 42 may be located on a control panel 44 of an operator's control station 46 located on the vehicle frame 22.

As noted, in one embodiment, the marking emitter 32 may include a plurality of spray nozzles 36. The spray nozzles 36 may, in one embodiment, be paint spray guns operated with compressed air. In such an embodiment, the survey vehicle 18 may include a compressor 48 which supplies compressed air to a compressed air storage tank 50. Compressed air from storage tank 50 may be provided to each of the spray nozzles 36 via a manifold distribution line 52. A branch of the manifold distribution line 52, such as branch 52A leading to spray nozzle 36A, may have a control valve 54A disposed therein by means of which the controller 42 may turn the spray nozzle 36A on and off to selectively spray a paint marking on the ground surface 10. The spray nozzle 36A may be provided with liquid paint from a paint supply 56A.

Optionally, the marking emitter 32 may be configured in the form of a digital printer head using any desired printing technology capable of spraying markings on to the ground surface.

In the schematic plan view of FIG. 4 only the first three spray nozzles with associated apparatus are shown on the left hand side of FIG. 4 and are designated as 36A, 36B, 36C. It will be understood that array of spray nozzles with associated sensors, control valves and paint supplies will be arranged across the entire width 38 of the survey vehicle 18.

Additionally, the survey vehicle 18 may be provided with a heater 58 for providing hot air to be distributed by a blower 60 to a dryer 62 extending across the width 38 of the path being traversed by the survey vehicle 18. The hot air may be directed downwardly via jets so as to dry the ground surface 10 in advance of the marking emitter 32 painting the surface of the ground surface 10.

Thus, in the embodiment illustrated schematically in FIG. 4, there is an array of sensor elements 30A, 30B, 30C etc., extending across the width 38 of the survey vehicle 18, and each sensor element has associated therewith one of the spray nozzles 36, so that when the presence of an underground obstacle is detected by the sensor 30 it will be shortly followed by the spray nozzle 36A spraying the ground surface above the location where the underground obstacle was detected.

If the spray nozzle 36A is located substantially rearward of the sensor element 30A, then the controller 42 may be programmed to delay the spraying operating until the spray nozzle 36A is above the location where the sensor element 36A detected the underground object. On the other hand if the spray nozzle 36A is located very close to the sensor element 36A it is suitable to let the spray nozzle immediately respond to the detection of the underground object.

Other accommodations may be made for the difference in lateral location of the sensor element 30A and its associated spray nozzle 36A. For example, the spray nozzle 36A could be placed at an angle so that it would spray the ground immediately below the sensor element 30A. Also, the vehicle 18 may be provided with a distance sensor 64 which may for example be a rotational sensor detecting the rotation of one of the wheels 26. The controller 42, may be programmed to know the distance by which the spray nozzle 36A trails the sensor 30A and may thus control the appropriate timing of the opening of the control valve 54A.

Figure 6:
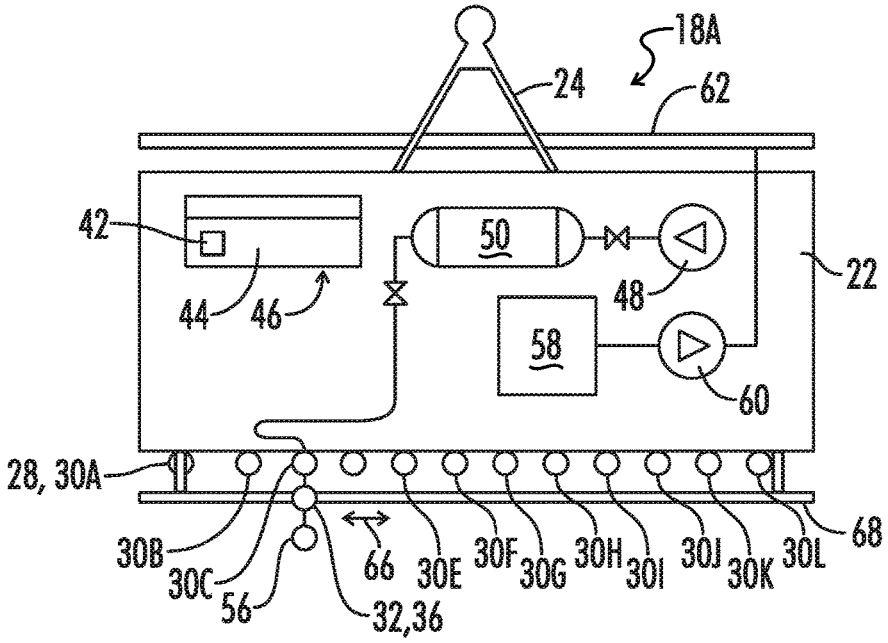
FIG. 6 is a schematic plan view similar to similar to FIG. 4, showing an alternative embodiment wherein the spray emitter is constructed to be moveable laterally across the width of the survey vehicle.

The Embodiment of FIG. 6

Referring now to FIG. 6, a modified embodiment of the survey vehicle 18A is shown. Features substantially similar to those of the survey vehicle 18 of FIG. 4 are identified by like numerals. In the embodiment of FIG. 6, instead of having an array of spray nozzles with each spray nozzle being associated with one of the sensor elements 30, the emitter 32 includes a single spray nozzle 36 which is laterally moveable as indicated by arrow 66 along a rail 68 supported from vehicle frame 22.

Thus in the view shown in FIG. 6, the spray nozzle 36 has been moved to a location immediately behind sensor element 30C. The spray nozzle 36 may be moved along the rail 68 to a position behind any of the sensor elements 30A-30L of the sensor 28.

Figure 7:
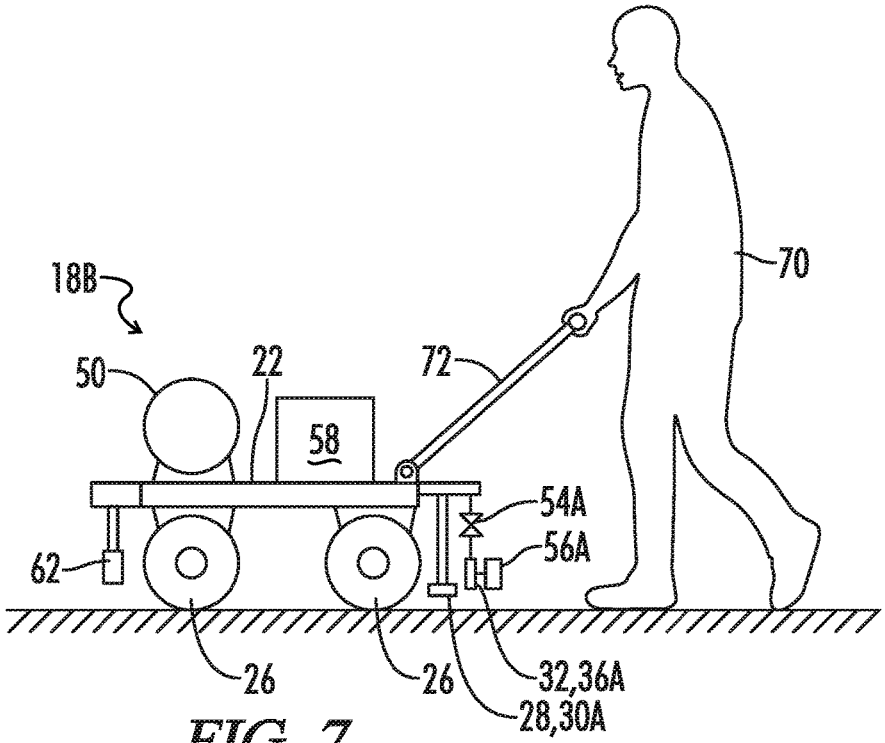
FIG. 7 is a schematic elevation view of a smaller survey vehicle designed to be manually powered.

The Embodiment of FIG. 7

FIG. 7 shows a schematic side elevation view similar to FIG. 5 of a modified survey vehicle 18B constructed to be manually propelled such as by being pushed by a human operator 70. In this instance a handle 72 is attached to the vehicle frame 22 and is configured to be grasped by the human operator 70.

Sensor Technologies

Numerous available technologies may be utilized for the sensor 28 and particularly for the sensor elements 30 thereof.

One primary goal of the obstacle detection system described herein is to detect buried metallic objects. Such objects may for example be a buried steel pipeline or a buried manhole cover or the like.

One technology for detecting such buried metal objects is the use of conventional metal detector technology which uses magnetometers as the sensor elements 30. Such magnetometers can determine the presence and approximate depth of buried metal objects in a known manner. A plurality of magnetometers located at different distances above the ground may be utilized to improve the depth sensing capability of magnetometer technology.

Another suitable technology is the use of ground penetrating radar. One advantage of using ground penetrating radar is that it can detect changes in material properties other than the presence of metal obstacles. Thus large buried rocks may be detected with ground penetrating radar.

Hybrid systems may also be utilized combining sensors of the various types described above.

Figure 8:
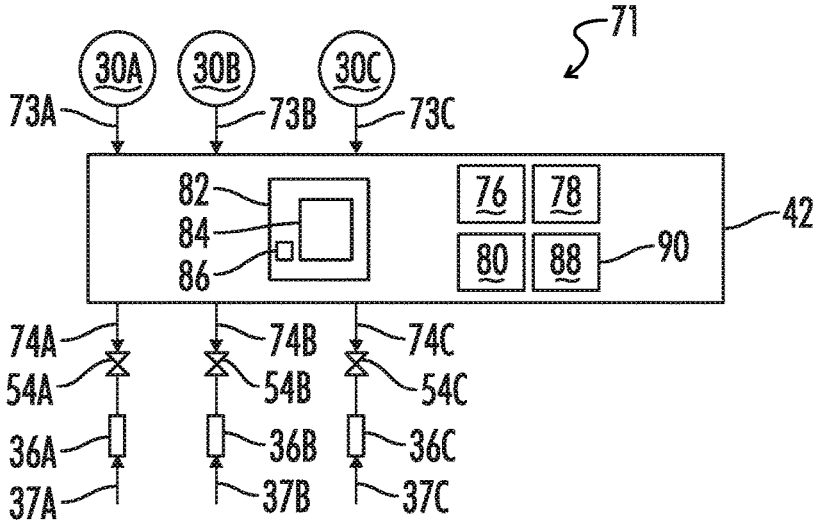
FIG. 8 is a schematic illustration of the control system of the survey vehicle.

The Survey Vehicle Controller of FIG. 8

Referring now to FIG. 8, an automatic control system 71 for the survey vehicle 18 is there schematically shown. The automatic control system 71 includes the controller 42. The controller 42 receives input signals from the sensor elements 30A, 30B, etc. via communication lines 73A, 73B, etc. The controller 42 may also receive other signals indicative of various operational functions of the survey vehicle 18. Communication of marking emitter actuation signals from the controller 42 to the control valves 54 are schematically illustrated in FIG. 8 by the communication lines 74A, 74B, etc.

Controller 42 includes or may be associated with a processor 76, a computer readable medium 78, a data base 80 and an input/output module or control panel 82 having a display 84. An input/output device 86, such as a keyboard or other user interface, is provided so that the human operator may input instructions to the controller. It is understood that the controller 42 described herein may be a single controller having all of the described functionality, or it may include multiple controllers wherein the described functionality is distributed among the multiple controllers.

Various operations, steps or algorithms as described in connection with the controller 42 can be embodied directly in hardware, in a computer program product 88 such as a software module executed by the processor 76, or in a combination of the two. A computer program product 88 can reside in RAM memory, flash memory, ROM memory, EPROM memory, EEPROM memory, registers, hard disk, a removable disk, or any other form of computer-readable medium 78 known in the art. An exemplary computer-readable medium 78 can be coupled to the processor 76 such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

The controller 42 may be configured to control markings emitted by marking emitter 32 in accordance with a pre-programmed function 90 which may be incorporated as part of the computer program 88.

In one embodiment the pre-programmed function 90 may be such that the controller 42 is configured to spray markings on the ground 10 in a manner so as to provide a visible indication of the depth of the obstacle 14 under the ground surface 10.

Figure 14:
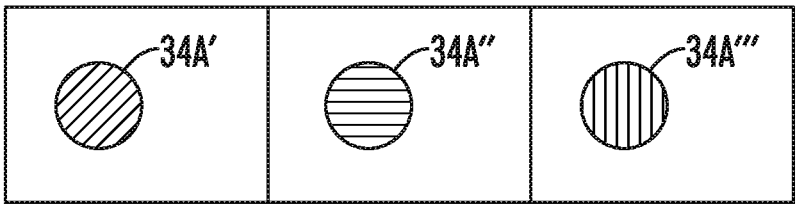
FIG. 14 is a schematic illustration showing three comparative surface markings using different colors as an indication of the depth buried article.

In one embodiment the pre-programmed function 90 may be such that the visible indication of depth includes a variable color of the visible marking as further described below with regard to FIG. 14.

In another embodiment the pre-programmed function 90 may be such that the controller 42 is configured to provide a visible indication of depth including a variable intensity of the visible marking as further described below with regard to FIG. 15.

In another embodiment the pre-programmed function 90 may be such that the controller 42 is configured to provide the visible indication of depth including a visible indication of a maximum permissible milling depth that will avoid the buried obstacle 14.

In another embodiment the pre-programmed function 90 may be such that the controller 42 is configured to provide the visible indication of depth including a variation in sprayed indicia as the visible indication of depth. For example, the sprayed indicia may be in the form of numerals indicating depth of the buried obstacle 14 below the ground surface 10 as further described below with regard to FIG. 16.

The Milling Machine

FIG. 10 schematically illustrates in side elevation view the milling machine 16 which may be utilized in conjunction with the survey vehicle 18 to later mill the ground surface and to avoid the buried obstacles which have been identified by the survey vehicle 18.

The milling machine 16 depicted in FIG. 10 is in the form of a large milling machine for road milling. The milling machine 16 includes a plurality of ground engaging supports such as front tracks 92A and rear tracks 92B. Milling machine 16 includes a machine frame 94 supported from the ground engaging supports 92A and 92B.

A milling drum 96 is supported from the milling machine frame 94. A milling depth 98 of the milling drum 96 into the ground below the ground surface 10 is determined by extending and contracting hydraulic rams 100A and 100B associated with the tracks 92A and 92B.

It will be understood that the milling machine 16 could also be in the form what is generally known as a recycler or soil stabilizer machine. In a recycler or soil stabilizer machine, the milling drum 96 is adjustable in height relative to the machine frame 94 in a known manner. Other constructions of milling machines, such as a small milling machine having the milling drum between the rear wheels, may also be used.

The milling machine 16 has a driver's station 102 from which the human operator of the machine controls the operation of milling machine 16. The human operator may manually steer the milling machine 16 via steering system 104 which controls the direction of the driving tracks 92A and/or 92B. A milling machine controller 106 is located on the milling machine 16 and will interact with various sensors and inputs to control the milling depth 98 and/or to steer the milling machine 16 along a desired path.

Figure 11:
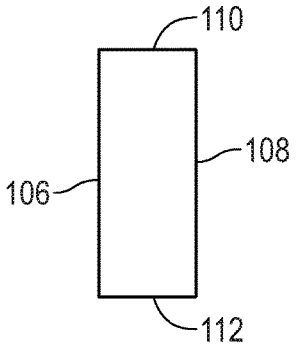
FIG. 11 is a schematic plan view of the footprint of the milling drum as it mills the ground surface.

The portion of the milling drum 96 of most interest is the footprint of the intersection of the milling drum 96 with the ground surface 10. As seen in FIG. 11, the footprint is generally rectangular in shape and includes a forward cutting line 106, a rearward cutting line 108, and two side lines 100 and 112.

It will be appreciated that as the milling depth 98 changes the location of the forward cutting line 106 and rearward cutting line 108 relative to the machine frame 94 and to each other varies. The cutting footprint of the milling drum 96 at the ground surface 10 is rectangular in shape as seen in FIG. 11, and the cutting length of the rectangle in the direction of travel represented by the sidelines 110 and 112 increases as the milling depth 98 increases.

As is further explained below, the human operator of the milling machine 16 may directly visually observe the markings placed on the ground surface 10 by the survey vehicle 18 and the human operator may fully control the milling depth 98 and the steering of the milling machine 16 to avoid the marked locations either by raising the milling drum 96 above the buried obstacles, or by steering the milling machine 16 so as to avoid the buried obstacles. Additionally, the milling machine 16 may be equipped to automatically observe and respond to the visible markings placed on the ground surface. For example, the milling machine 16 may include a sensor 114, which may for example be a camera 114, for observing the ground surface 10 in front of the milling machine 16.

Figure 12:
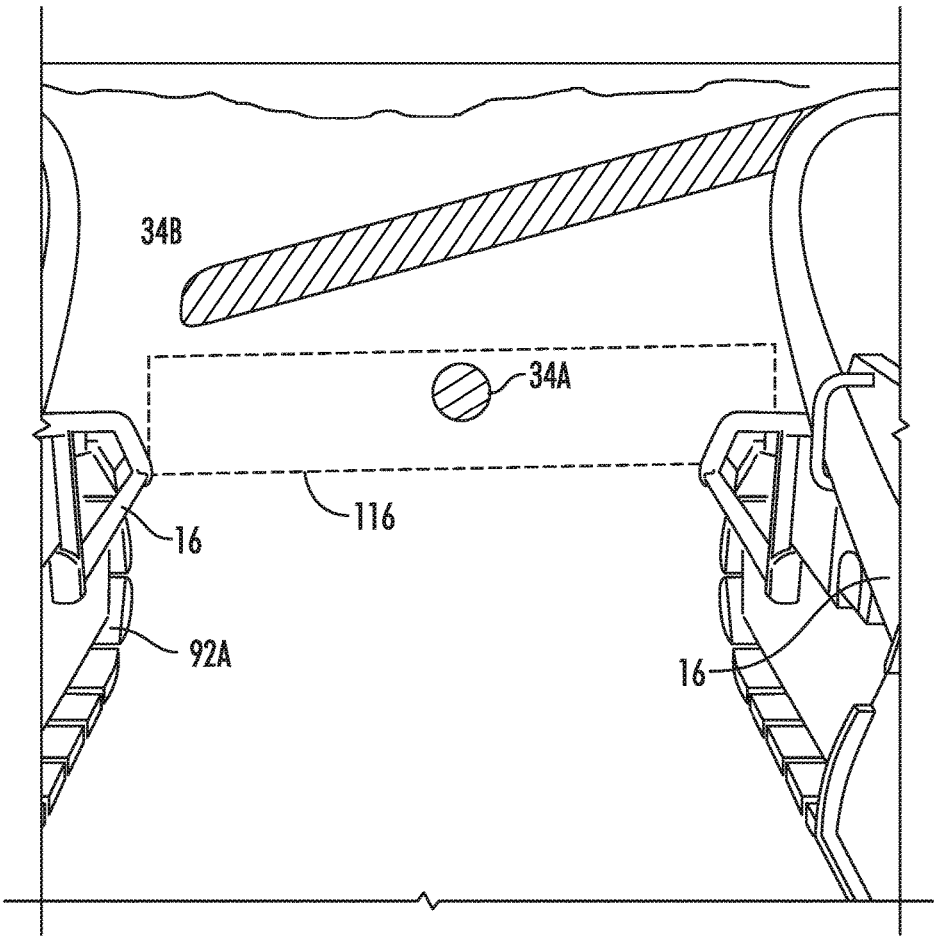
FIG. 12 is a schematic perspective view showing the field of view of a camera type sensor mounted on the front of the milling machine to detect the presence of visible markings on the ground surface.

FIG. 12 schematically illustrates the ground surface 10 ahead of the milling machine 16 as viewed from a position corresponding to that of the camera 114. In FIG. 12, the entire landscape ahead of the milling machine 10 is illustrated which it will be understood will be far more than the actual field of view of any given camera 114. For example, the actual field of view of the camera 114 might be as shown in the phantom outline box 116 representing the field of view of the camera 114.

Figure 13:
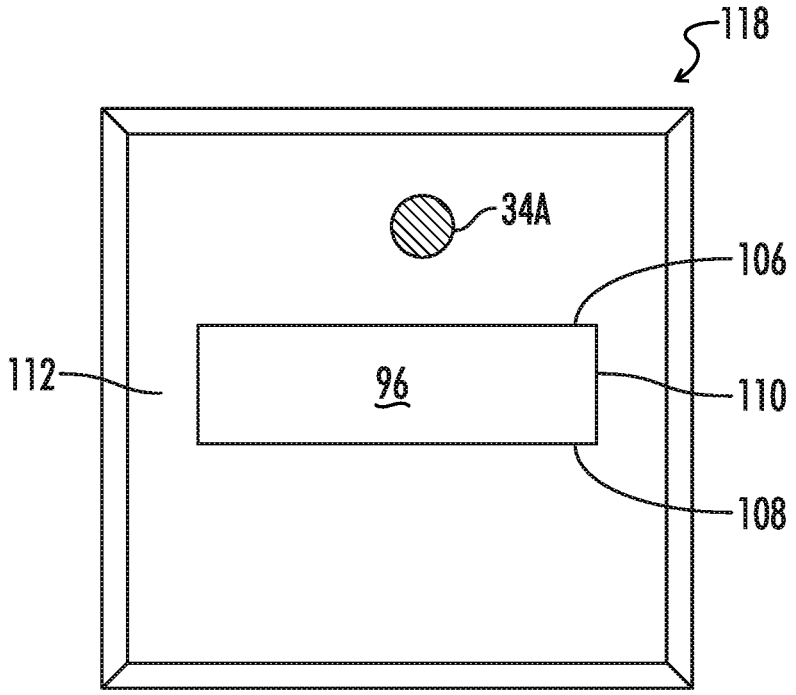
FIG. 13 is a schematic illustration of the display screen of the milling machine.

One way that the camera 114 may be utilized in combination with control by the human operator of the milling machine 16, is to display the images captured by camera 114 with a time shift so that the human operator views a display screen depicting a virtual reality image representative of the location of the observed images relative to the rectangular footprint of the milling drum 96. This can be accomplished with the same techniques set forth in U.S. Patent Application Publication No. 2016/0060826 of Berning et al., and assigned to the assignee of the present invention, the details of which are incorporated herein by reference. Such a display screen 118 is schematically illustrated in FIG. 13. The display screen in FIG. 13 is illustrating a point in time where the footprint of the milling drum 96 cutting into the ground surface 10 is approaching the location of the visible marking 34A located above the buried obstacle 14A.

By observing the proximity of the footprint of milling drum 96 to the marking 34A, the human operator may raise the milling drum 96 at an appropriate time, or may steer the milling machine 16 to avoid the buried obstacle.

Alternatively, the controller 106 of the milling machine 16 may be configured to provide automatic control of the milling machine 16 in response to observed locations of visible markings 34 on the ground surface 10 by the camera 114.

Figure 9:
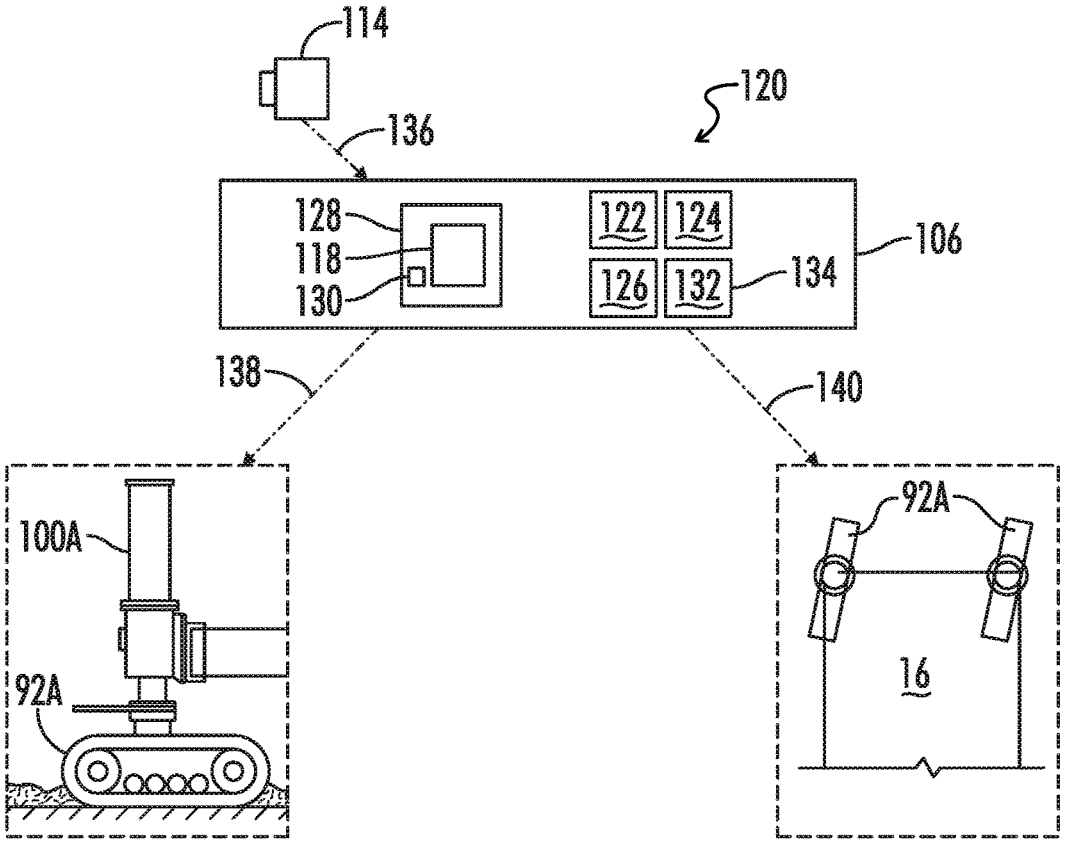
FIG. 9 is a schematic view of a control system for the milling machine of FIG. 10.

As schematically illustrated in FIG. 9, the milling machine controller 106 may be part of a milling machine control system 120.

The milling machine controller 106 may be constructed in a manner similar to the survey vehicle controller 42 previously described. Thus, the milling machine controller 106 may include a processor 122, a computer readable medium 124, a database 126, and an input/output module or control panel 128 which may include the display screen 118.

An input/output device 130 such as a keyboard or other user interface is provided so that the human operator of the milling machine 16 may input instructions to the milling machine controller 106.

Various operations, steps or algorithms as described herein in connection with the milling machine controller 106 can be embodied directly in hardware, in a computer program product 132 such as a software module executed by the processor 122, or in a combination of the two. As described above regarding the survey vehicle controller 42, the computer program product 132 can reside in any form of computable reader medium 124 known in the art. As further described above regarding survey vehicle controller 42 the processor 122 may have any of the forms described above for the processor 76.

The milling machine controller 106 may be configured to control the operation of the milling machine 16 in accordance with a pre-programmed function 134 which may be incorporated as part of the computer program 132.

The controller 106 may receive input signals such as from the camera 114 as indicated by communication line 136. The controller 106 may generate control signals to control the milling depth 98 and/or to control the steering of the milling machine 16. In FIG. 9, the control signal for adjustment of the height of the lifting column 100A associated with track 92A is communicated via communication line 138. Similar signals may be sent to each of the lifting columns. Similarly, control signals to control the steering of the tracks so that the milling machine 16 can avoid an obstacle are communicated over communication line 140.

Methods of Preparing the Ground Surface for Milling

Figure 1B:
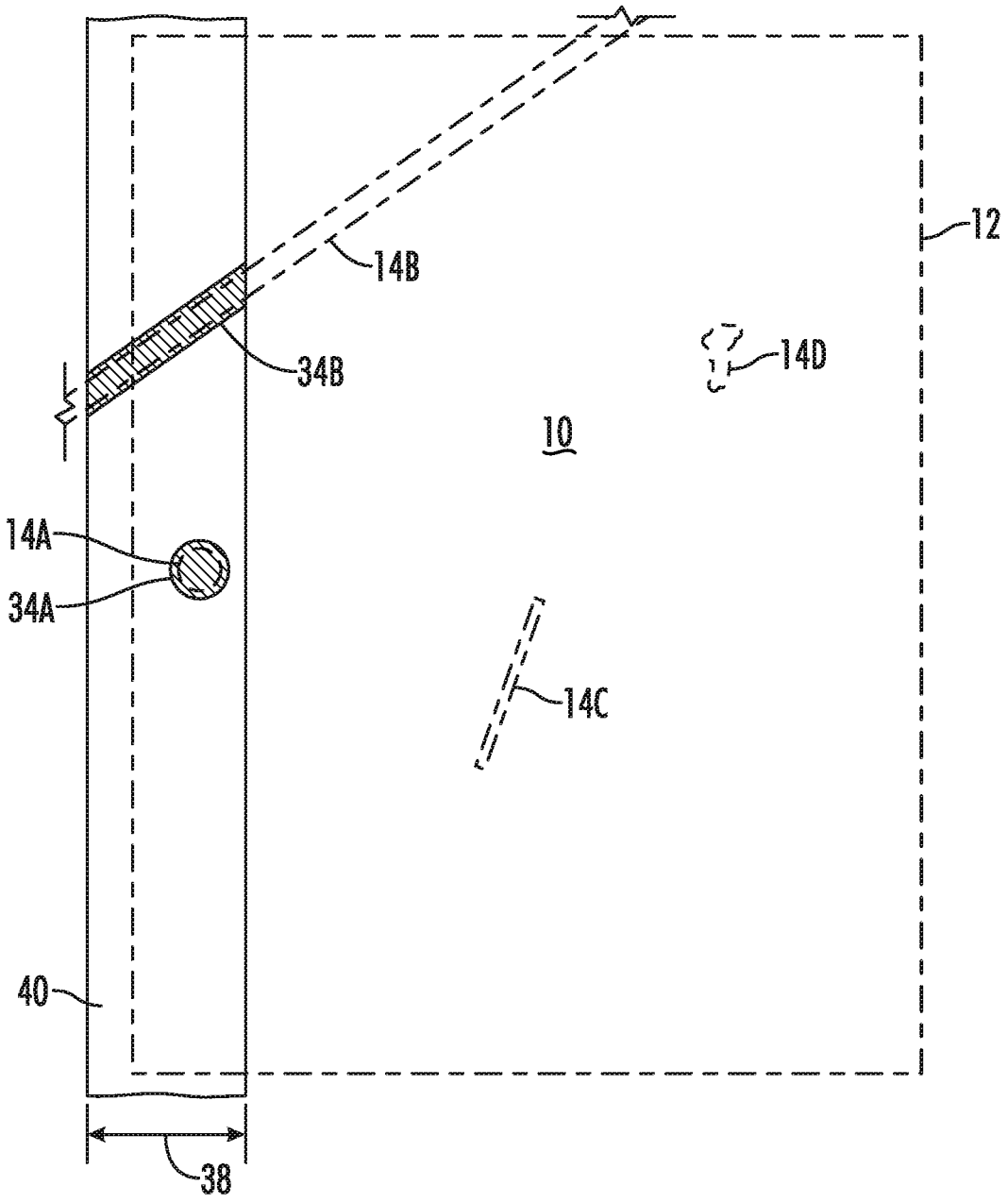
FIG. 1B is a view similar to FIG. 1A after the survey vehicle has made a first pass from bottom to top thru the area to be surveyed.
Figure 1C:
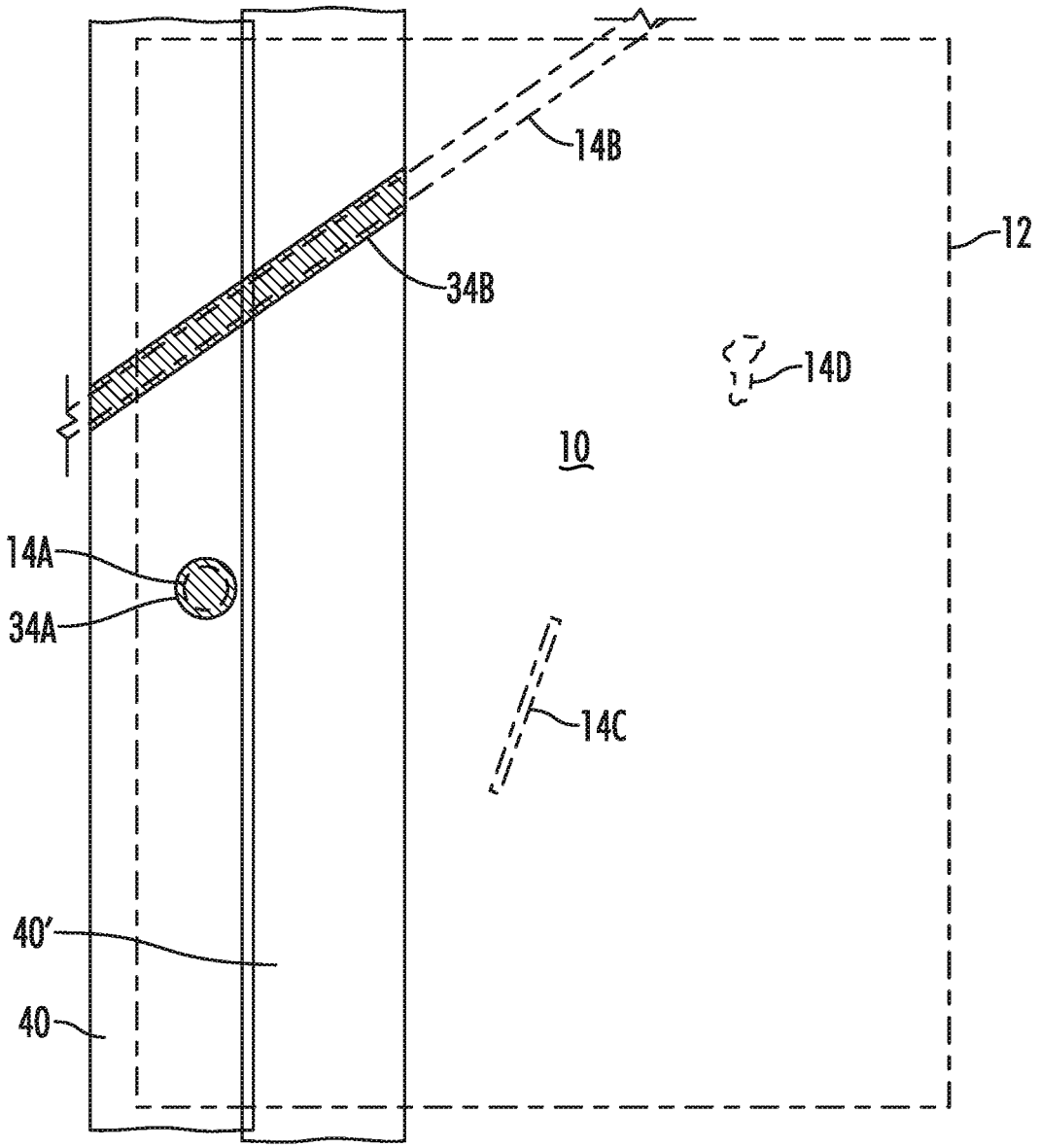
FIG. 1C is another view similar to FIGS. 1A and 1B after the survey vehicle has made a second pass which overlaps the first pass.

Referring now to FIGS. 1A-1C, a sequential series of illustrations are there shown for the preparation of the area 12 of the ground surface 10 to be milled by a milling machine such as 16.

Buried within the area 12 are the plurality of underground obstacles which have been schematically identified by dash lines as 14A, 14B, 14C and 14D.

The tow vehicle 20 and the survey vehicle 18 pulled by the vehicle 20 are shown in the lower left corner of the area 12 as they are beginning to make a first pass over the area 12.

Thus, prior to performing any milling operation on the area 12, the area 12 will be traversed by the survey vehicle 18 which has previously been described.

As the survey vehicle 18 traverses the area 12 it will detect the presence of buried obstacles 14A-14D with its sensor 20 including the sensor elements 30A-30C, etc.

Each sensor element 30 upon detecting the presence of the buried obstacle 14 there below will generate a sensor output signal which may be conveyed over communication lines 73A, 73B, 73C etc. to the survey vehicle controller 42.

The survey vehicle controller 42 receives those sensor output signals over communication lines 73 and generates sprayer actuation signals communicated to the various control valves 54A, 54B, 54C over communication lines 74A, 74B, 74C etc., in response to the sensor output signals.

The spray nozzles 36A, 36B, 36C, etc. of marking emitter 32 are actuated upon the opening of their respective control valves 54 in response to the sprayer actuation signals, and emit a spray such as 37A, 37B or 37C seen in FIG. 8 onto the ground surface 10 above the obstacles 14 thus creating the visible markings 34A, 34B, 34C and 34D over the location of the buried obstacles.

Thus, in FIG. 1B, the tow vehicle 20 and survey vehicle 18 have made a first pass from bottom to top across the area 12. The path of the first pass is designated as 40 and has a width 38.

As is seen in FIG. 1B, as the survey vehicle 18 passed over the first obstacle 14A, and a portion of the second obstacle 14B, the survey vehicle 18 painted the ground surface 10 above the buried obstacles with the visible markings 34A and 34B.

In FIG. 1C, the survey vehicle 18 has made a second pass indicated as 40' across the area 12. It is noted that there is preferably a slight overlap between the first pass 40 and the second pass 40'. As the survey vehicle made the second pass 40', it extended the visible marking 34B across another portion of the buried obstacle 14B as shown in FIG. 1C.

The process will preferably continue until the survey vehicle 14 has covered the entire region 12, and has painted visible markings on the ground surface 10 above each of the buried obstacles 14.

This process may be accomplished in a series of overlapping strip passes like shown in FIGS. 1B and 1C. While making the various strip passes the location of the surveyed portion of the area may be noted by marking the ground surface with lines such as the path outlines shown in FIG. 1C to denote the portions of the area 12 which have already been surveyed. This aids the operator in choosing an efficient survey pattern with minimal overlap of surveyed areas on the one hand, and without missing a part of the area 12 on the other hand.

Figure 2:
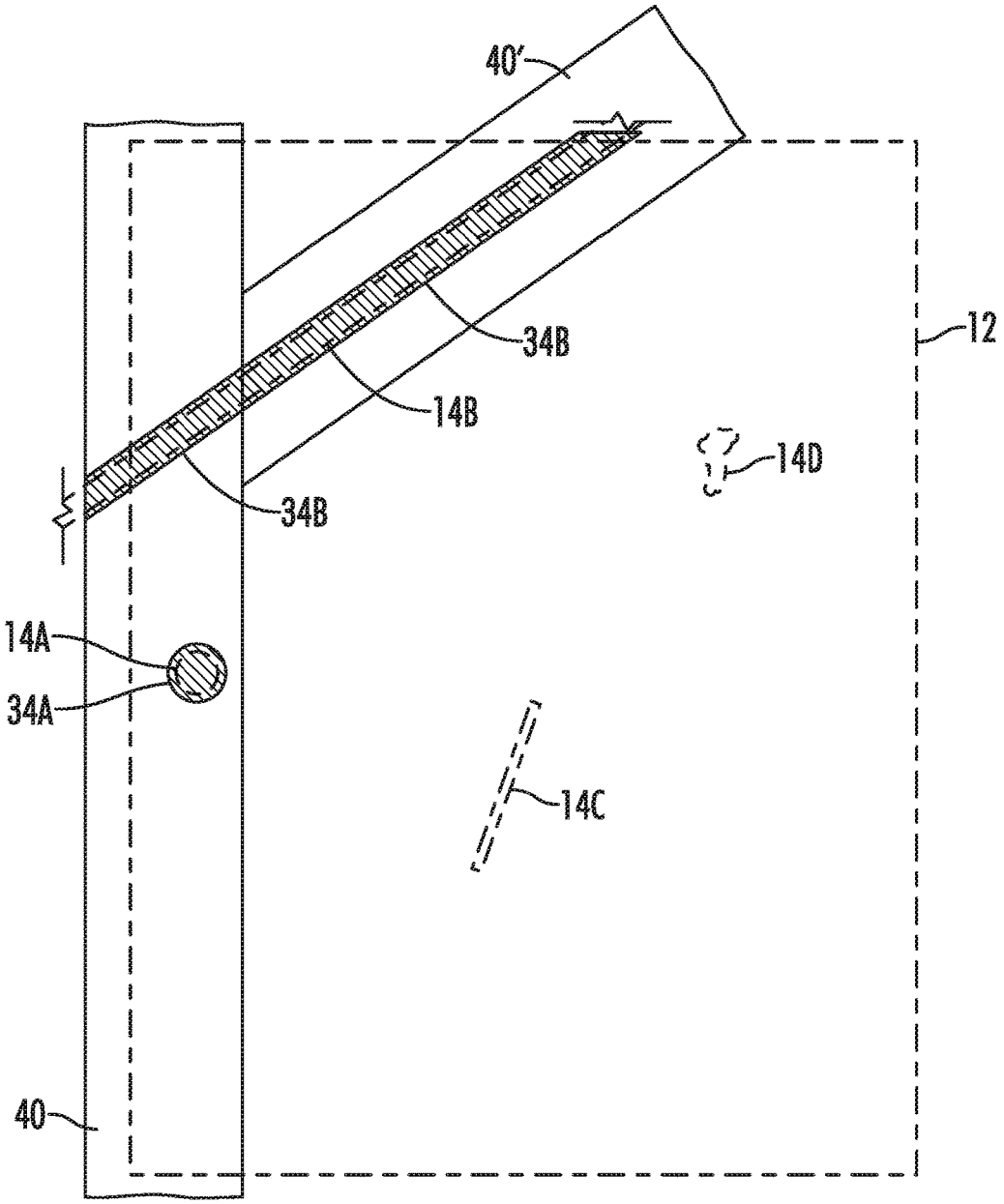
FIG. 2 is a view similar to FIGS. 1A-1C illustrating an optional method after the steps shown in FIG. 1B, wherein the survey vehicle follows the buried obstacle which was identified in the first pass.

Optionally, another technique may be utilized as schematically illustrated in FIG. 2.

FIG. 2 is a view somewhat similar to FIGS. 1B and 1C. In FIG. 2, a first pass 40 was made identical to that described above with regard with FIG. 1B. Subsequently, instead of making a plurality of side by side passes, upon the recognition that there was a continuous elongated buried obstacle 14B apparently extending further through the region 12, the operator made a decision to follow the apparent path of the buried obstacle 14B, thus creating a second path 40' of the survey vehicle 18 which followed the path of the buried obstacle 14B. This insures the marking of the entirety of the continuous buried obstacle within the area 12.

Then the operator may resume a path of side by side traversals or whatever is most efficient to both cover the entire area 12 and to make certain that previously identified objects are followed to their full extent thru the area 12.

When using a survey vehicle 18 such as shown in FIGS. 4-6 pulled by a tow vehicle 20, this allows the surveying operation to be performed at a much higher speed than could be done with sensors mounted on a milling machine. Thus, when performing the survey operation with the tow vehicle 20 and towed survey vehicle 18, the surveying is preferably performed at a towing speed of at least 10 km/hr., and in many instances may be performed at a survey speed even higher up to 20 to 30 km/hr.

By using a survey vehicle 18 which is separate from the milling machines which will later perform the milling operations, the surveying and marking of underground obstacles can be performed at much higher speeds than they could be performed with detectors mounted on a milling machine, and it allows early identification of the sub-surface obstacles and allows for planning of the subsequent milling operation to most efficiently deal with the presence of the sub-surface obstacles.

On the other hand, the surveying can be done with a manually propelled vehicle such as the survey vehicle 18B illustrated in FIG. 7. Of course when used in a manually propelled vehicle the survey operation will be performed at much slower speeds below 10 km/hr.

When utilizing the survey vehicle embodiment shown in FIG. 4 having an array of sensor elements 30 followed by an array of spray nozzles 36, with there being one spray nozzle such as 36A corresponding to each sensor element such as 30A, one or more of the spray nozzles 36 are actuated to spray the visible marking 34 on the ground surface 10.

When using the survey vehicle embodiment of FIG. 6 having an array of sensor elements 30, and a single spray nozzle 36, the spray nozzle 36 is moved to a selected location in response to the detection of buried obstacles by one or more of the sensor elements 30 and then actuated to spray the ground surface behind the sensor element which has identified the presence of a buried obstacle.

Optionally, the process may include a step of drying the ground surface 10 prior to spraying of the visible marking on the ground surface 10. As previously noted the survey vehicle 18 may include a heater 58 and blower 60 associated with a heater outlet 62 for blowing heated air onto the ground surface 10 in advance of the marking operation.

The liquid paint or other marking fluid carried in the paint supplies 56 may be a waterproof paint. Preferably, the paint or other marking fluid utilized to form the visible markings 34 on the ground surface 10 is made from a material that can withstand expected environmental conditions for a period of a few days. Thus a waterproof paint that can withstand rain and snow is preferred.

Preferably the visible marking 34 will cover an outer contour of the buried obstacle with a modest amount of overspray to ensure that the visible marking completely covers the footprint or contour of the buried obstacle.

Types of Marking Indicia

In its simplest form, the above described methods will simply paint a visible marking on the ground surface 10 to indicate the presence of a buried obstacle some place below the visible marking, but with no indication of the depth of the article. Thus, the various visible marking such as 34A and 34B described above with regard to FIGS. 1B and 1C may simply be painted in an identical manner to indicate the presence of a buried article.

Optionally, however, sensor elements 30 of a type which are capable of detecting the depth of the buried article may be utilized, and the sensor signals received by survey vehicle controller 42 via communication lines 73 may include information representative of the depth of the buried article.

In those cases, the survey vehicle controller 42 and associated emitter 32 may be configured such that the visible markings 34 include a visible indication of the depth of the obstacle 14 under the ground surface 10. This can be done in several ways, which are schematically illustrated in FIGS. 14-16. A first option, as schematically illustrated in FIG. 14 is to provide visible markings such as 34A', 34A", and 34A". In this instance the markings have been lined through in different directions to schematically illustrate different colors such as for example a green marking 34A' to indicate a deep obstacle below the desired milling depth, a yellow marking 34A" to indicate a buried obstacle at a depth near to that of the milling depth 98, and a red marking 34A'" to indicate a buried obstacle very near the surface which definitely must be avoided by the milling drum.

Figure 15:
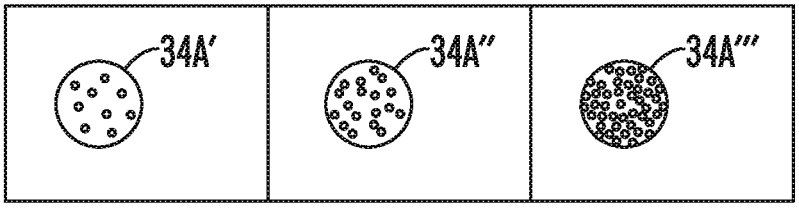
FIG. 15 is a schematic illustration similar to FIG. 14 depicting the use of increased intensity of the surface marking to indicate the depth of the buried obstacles.
Figure 16:
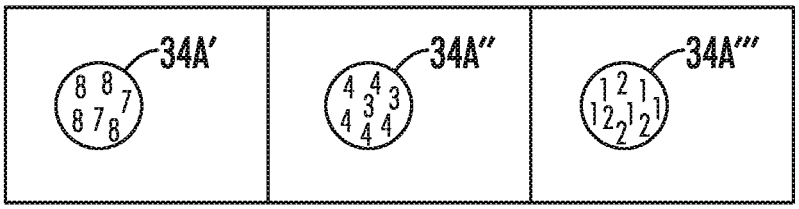
FIG. 16 is a view similar to FIGS. 14 and 15 showing the use of numeric indicia sprayed on the ground surface to indicate either the depth of the buried article or optionally a safe milling depth.

Similarly, FIG. 15 schematically represents three comparative markings 34', 34A", and 34A'", each of increasing intensity as represented by the greater density of painted spots within the marked area.

Similarly, FIG. 16 shows three comparative markings 34A', 34A", and 34A'" in which the indicia sprayed on the ground surface are in the form of Arabic numerals representative of the approximate depth of the buried article at the sprayed location.

Optionally, a display similar to that in FIG. 16 can indicate a maximum permissible milling depth that will avoid a buried obstacle, which for example may add a safety factor of a selected distance, for example four millimeters to the measured depth.

Figure 3:
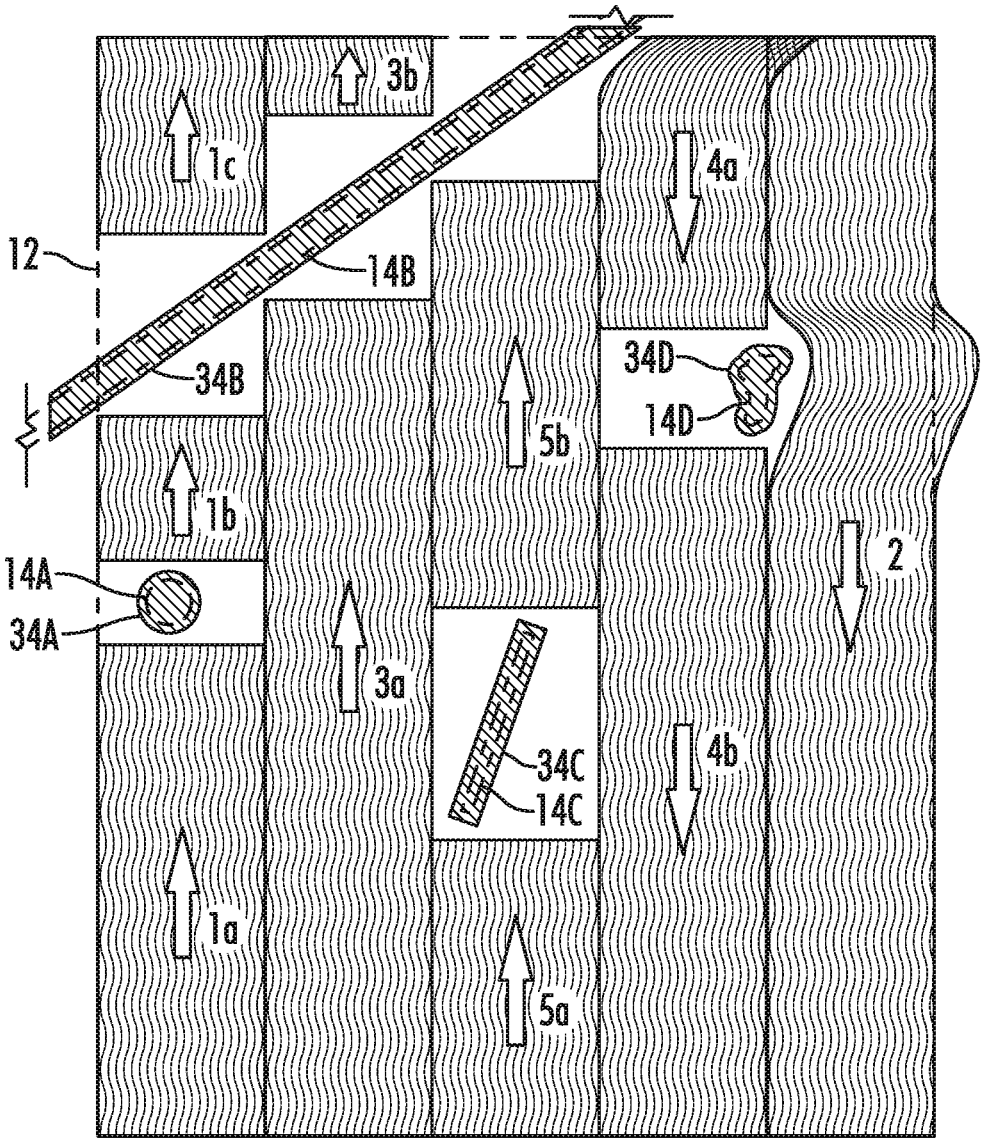
FIG. 3 is a schematic plan view of the area of the ground surface after milling with a milling machine.

Milling Operations of FIG. 3

Turning now to FIG. 3, a schematic representation is there shown of milling operations being performed on the area 12 after the area 12 has been surveyed by the survey vehicle 18 and after the various underground obstacles 14 have been marked with surface markings 34A, 34B, 34C and 34D.

In the illustrated example, the milling machine 16 of FIG. 10 has been utilized to mill the area 12 after the area 12 has been surveyed and marked by the survey vehicle 18. In the illustrated example, the milling machine 16 began at the lower left corner of the area 12 and made a first pass represented by arrows 1*a*, 1*b* and 1*c*. Thus, the milling machine began milling at the lower left corner of the area 12 and milled the first partial pass 1*a* until approaching the first surface marking 34A. In this case, the operator or the automated control system of the milling machine 16 raised the milling drum as the milling machine passed over the first obstacle 34A. Optionally, if the obstacle 14A is located sufficiently deep below the elevation of the bottom of the milling drum 96 as shown for example in FIG. 10, the operator could have continued to mill across the location of the obstacle 14A. Such information for example could be communicated to the operator of the milling machine 16 by using visible markings 34 which are representative of the depth of the buried obstacle.

Returning to FIG. 3, as the first pass of the milling machine continued, the milling drum was again engaged with the ground thru the path 1*b*, then again raised to pass over the buried obstacle 14B and then lowered back into contact with the ground surface to complete the first pass 1*c*. Then the milling machine reversed its direction and moved to the second pass indicated as 2 on the right hand side of the area 12 in FIG. 3. The second pass 2 is a continuous pass except that it is seen that the driver of the milling machine steered the milling machine around the obstacle 14D.

Then the third pass of the milling machine is represented by arrows 3*a* and 3*b*. Again during the third pass the milling drum was raised to pass over the obstacle 14B.

Then the milling machine again moved downward through pass 4*a* and 4*b*. It is noted that at the beginning of pass 4*a*, the milling machine 16 steered around the buried pipeline 14*b* and was subsequently raised to pass over the buried obstacle 14*d*.

Finally the milling machine completed the milling operation as indicated by arrows 5*a* and 5*b* to do a final pass which was raised to pass over the buried obstacles 14C and 14B.

Although the milling operation of FIG. 3 has been described as multiple passes of a single milling machine 16, it will be appreciated that various portions of the area 12 could be milled with multiple milling machines simultaneously.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A method of preparing an area of a ground surface to be milled by a milling machine, the method comprising:

a) prior to performing any milling operation on the area of the ground surface, traversing the area with a survey vehicle separate from the milling machine, the survey vehicle including a sensor, a marking sprayer and a controller;

b) detecting the presence of a buried obstacle with the sensor and generating a sensor output signal indicative of the presence of the obstacle;

c) receiving the sensor output signal in the controller and generating a sprayer actuation signal in response to the sensor output signal; and d) actuating the marking sprayer in response to the sprayer actuation signal and spraying the ground surface above the obstacle with a visible marking emitted from the sprayer, the visible marking including a visible indication of a depth of the obstacle under the ground surface.

2. The method of claim 1, wherein:

in step (a) the survey vehicle is a non-self-propelled vehicle towed by a self-propelled towing vehicle.

3. The method of claim 2, wherein:

step (a) is performed at a towing speed of at least 10 km/hr.

4. The method of claim 1, wherein:

step (a) further comprises towing the survey vehicle at a towing speed of at least 10 km/hr.

5. The method of claim 1, wherein:

in step (a) the survey vehicle is a manually propelled vehicle.

6. The method of claim 1, wherein:

step (a) further includes detecting and marking a first portion of a continuous buried obstacle; and the method further includes following a path of the obstacle with the survey vehicle and marking the entirety of the continuous buried obstacle within the area of the ground surface.

7. The method of claim 1, wherein the visible indication of depth includes a variable color of the visible marking.

8. The method of claim 1, wherein the visible indication of depth includes a variable intensity of the visible marking.

9. The method of claim 1, wherein the visible indication of depth includes a variation in sprayed indicia as the visible indication of depth.

10. The method of claim 1, wherein the visible indication of depth includes a visible indication of a maximum permissible milling depth that will avoid the buried obstacle.

11. The method of claim 1, wherein:

in step (a) the sprayer includes an array of spray nozzles distributed across a width of a path traversed by the survey vehicle, and in step (d) one or more selected spray nozzles are actuated to spray the ground surface.

12. The method of claim 11, wherein:

in step (a) the sensor includes an array of sensor elements distributed across the width of the path traversed by the survey vehicle, each sensor element being associated with at least one of the spray nozzles.

13. The method of claim 1, wherein:

in step (a) the sprayer includes a spray nozzle movable across a width of a path traversed by the survey vehicle, and in step (d) the spray nozzle is moved to a selected location and actuated to spray the ground surface.

14. The method of claim 1, further comprising:

prior to step (d), drying the area of the ground surface.

15. The method of claim 1, wherein:

in step (d) the marking includes waterproof paint.

16. The method of claim 1, wherein:

in step (a) the area of the ground surface is traversed in a pattern so that substantially the entire area is surveyed and marked prior to performing the milling operation.

17. The method of claim 1, wherein:

in step (a) the survey vehicle is self-propelled.

18. The method of claim 1, wherein:

in step (d) the visible marking covers a contour of the buried obstacle.

19. The method of claim 1, further comprising:

e) milling the ground surface with at least one milling machine separate from the survey vehicle; and f) during step (e), observing the presence of the visible marking on the ground surface and controlling the milling machine so as to avoid impacting the obstacle with a milling drum of the milling machine.

20. The method of claim 19, wherein:

in step (f) the observing is performed by a human operator of the milling machine directly observing the ground surface.

21. The method of claim 19, wherein:

in step (f) the observing is performed by a human operator of the milling machine observing images of the ground surface on a display.

22. The method of claim 19, wherein:

in step (f) the observing is performed automatically by a visual sensor located on the milling machine, and the controlling of the milling machine is performed automatically in response to signals from the visual sensor.

23. The method of claim 19, wherein:

in step (f) the controlling of the milling machine includes adjusting a milling depth of the milling drum of the milling machine.

24. The method of claim 19, wherein:

in step (f) the controlling of the milling machine includes steering the milling machine around the obstacle.

25. The method of claim 19, wherein:

in step (f) the controlling of the milling machine includes stopping the milling machine.

26. The method of claim 19, wherein:

step (e) is performed with a plurality of milling machines operating simultaneously or sequentially.

27. A survey vehicle apparatus for surveying an area of a ground surface and marking the ground surface to indicate the presence of buried obstacles, the apparatus comprising:

a vehicle frame;

a plurality of ground engaging units supporting the vehicle frame from the ground surface, all of the ground engaging units being non-powered so that the survey vehicle is non-self-propelled;

a sensor carried by the vehicle frame and configured to detect the presence of the buried obstacles and to generate sensor output signals indicative of the presence of the buried obstacles and indicative of a depth of each of the buried obstacles;

a marking emitter carried by the vehicle frame and configured to emit visible markings onto the ground surface above the buried obstacles, the visible markings including visible indications of the depths of the buried obstacles; and a controller configured to receive the sensor output signals and to generate actuation signals to actuate the marking emitter.

28. The apparatus of claim 27, wherein:

the visible indications of depths include a variable color of the visible markings.

29. The apparatus of claim 27, wherein the visible indications of depths include a variable intensity of the visible markings.

30. The apparatus of claim 27, wherein the visible indications of depths include a variation in sprayed indicia.

31. The apparatus of claim 27, wherein the visible indications of depth include a visible indication of a maximum permissible milling depth that will avoid the buried obstacle.

32. The apparatus of claim 27, wherein:

the marking emitter includes an array of spray nozzles distributed across a width of a path traversed by the survey vehicle apparatus.

33. The apparatus of claim 32, wherein:

the sensor includes an array of sensor elements distributed across the width of the path traversed by the survey vehicle apparatus, each sensor element being associated with at least one of the spray nozzles.

34. The apparatus of claim 27, wherein:

the marking emitter includes spray nozzle movable across a width of a path traversed by the survey vehicle apparatus.

* * * * *